US011866902B2

(12) United States Patent
Bond

(10) Patent No.: US 11,866,902 B2
(45) Date of Patent: Jan. 9, 2024

(54) UNDERPINNING PILE ASSEMBLY FOR SUPPORTING STRUCTURE UPON THE EARTH

(71) Applicant: PATENTS OF TOMBALL, LLC, Houston, TX (US)

(72) Inventor: Richard Bond, Houston, TX (US)

( * ) Notice: Subject to any disclaimer, the term of this patent is extended or adjusted under 35 U.S.C. 154(b) by 259 days.

(21) Appl. No.: 17/386,147

(22) Filed: Jul. 27, 2021

(65) Prior Publication Data

US 2023/0036763 A1 Feb. 2, 2023

(51) Int. Cl.

| | |
|---|---|
| ***E02D 5/52*** | (2006.01) |
| ***E02D 27/48*** | (2006.01) |
| ***E02D 5/30*** | (2006.01) |
| ***E02D 5/28*** | (2006.01) |

(52) U.S. Cl.

CPC ..... *E02D 5/523* (2013.01); *E02D 5/28* (2013.01); *E02D 5/30* (2013.01); *E02D 27/48* (2013.01); *E02D 2300/0032* (2013.01)

(58) Field of Classification Search

CPC .. E02D 5/523; E02D 5/28; E02D 5/30; E02D 27/48; E02D 2300/0032

See application file for complete search history.

(56) References Cited

U.S. PATENT DOCUMENTS

| | | | | |
|---|---|---|---|---|
| 5,288,175 | A | 2/1994 | Knight | |
| 5,399,055 | A | 3/1995 | Dutton, Jr. | |
| 5,511,909 | A * | 4/1996 | Calandra, Jr. | E21D 21/0046 405/259.1 |
| 5,713,701 | A | 2/1998 | Marshall | |
| 5,802,788 | A * | 9/1998 | Ozawa | E04C 5/122 52/223.13 |
| 6,179,526 | B1 | 1/2001 | Knight | |
| 6,193,442 | B1 | 2/2001 | May | |
| 6,200,070 | B1 | 3/2001 | Knight | |
| 6,543,967 | B1 | 4/2003 | Marshall | |
| 6,609,856 | B1 | 8/2003 | Knight | |
| 6,634,830 | B1 | 10/2003 | Marshall | |
| 6,659,692 | B1 | 12/2003 | May | |
| 6,718,648 | B1 | 4/2004 | Knight | |
| 6,722,820 | B2 | 4/2004 | Marshall | |
| 6,763,636 | B2 | 7/2004 | Dimitrijevic | |
| 6,799,924 | B1 | 10/2004 | Knight | |
| 6,848,864 | B1 | 2/2005 | Davie | |
| 6,872,031 | B2 | 3/2005 | May | |
| 6,881,012 | B2 | 4/2005 | Covington | |

(Continued)

*Primary Examiner* — Kyle Armstrong

(74) *Attorney, Agent, or Firm* — Egbert, McDaniel & Swartz, PLLC

(57) ABSTRACT

An underpinning pile assembly for supporting a structure upon the earth has a plurality of pile segments, a cable extending through a continuous passageway of the plurality of pile segments, and an anchor assembly positioned at the top of the plurality of pile segments. Each of the plurality of pile segments is stacked one upon another. The cable has a lower end affixed to one of the plurality of pile segments. The anchor has an opening that receives a portion of the cable therein so as to fix a position of an upper end of the cable. The anchor assembly has at least one column extending upwardly from an upper surface thereof. An adjustable support is affixed to the column and has a surface opposite the column that is adapted to support the structure thereon.

15 Claims, 7 Drawing Sheets

(56) References Cited

U.S. PATENT DOCUMENTS

| | | | | |
|---|---|---|---|---|
| 6,951,437 | B2 | 10/2005 | Hall | |
| 7,108,458 | B1 | 9/2006 | Davie, Jr. | |
| 7,195,426 | B2 | 3/2007 | May | |
| 7,267,510 | B2 | 9/2007 | Dimitrijevic | |
| 7,429,149 | B2 | 9/2008 | Price | |
| 7,857,549 | B1 | 12/2010 | Deshazer | |
| 8,500,368 | B1 | 8/2013 | Deshazer | |
| 2005/0025576 | A1 | 2/2005 | Dimitrijevic | |
| 2006/0067794 | A1* | 3/2006 | Mitchell | E02D 27/48 405/230 |
| 2006/0269364 | A1 | 11/2006 | May | |
| 2006/0275086 | A1 | 12/2006 | Dimitrijevic | |
| 2008/0317556 | A1 | 12/2008 | Price | |
| 2010/0021243 | A1 | 1/2010 | Dimitrijevic | |
| 2010/0021244 | A1 | 1/2010 | Dimitrijevic | |
| 2012/0255242 | A1* | 10/2012 | Patton | B66F 3/24 52/741.15 |
| 2014/0212223 | A1* | 7/2014 | Hill | E02D 5/64 405/251 |

* cited by examiner

UNDERPINNING PILE ASSEMBLY FOR SUPPORTING STRUCTURE UPON THE EARTH

CROSS-REFERENCE TO RELATED APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to the repair of building foundations by underpinning Additionally, the present invention relates to underpinning pile assemblies having steel pipes extending into the earth. Furthermore, the present invention relates to underpinning pile assemblies that are adjustable so as to adapt to various dimensions below the foundation of a building.

2. Description of Related Art Including Information Disclosed Under 37 CFR 1.97 and 37 CFR 1.98

There is a type of precast concrete pile used in the underpinning of building foundations comprised of vertically stacked, unconnected, precast concrete segments. These segments are pressed or driven vertically into the soil one at a time until an adequate load capacity is obtained. This type of pile is distinctive in that it can be installed with almost no clearance, usually beneath an existing structure.

Although serviceable, this pile has several significant disadvantages: (a) the pile segments are not aligned, other than being stacked on each other, and detrimental misalignments can occur; (b) independent inspection of the installed pile depth is only possible by providing full-time inspection personnel during installation to monitor the quantity of pile segments used at each pile location; and (c) the complete pile is an unreinforced stack of precast concrete segments.

Misalignment of the segments as they are installed can produce several conditions detrimental to the future pile stability. Lack of proper independent inspection of pile depth can lead to inadequate pile penetration, which in highly expansive soils, produces an unstable installation subject to continued movements caused by seasonal changes in soil moisture content. An unreinforced or non-continuously reinforced pile is subject to permanent separation at segment joints or breakage at segment midpoints when installed in clay soils having high shrink-swell potentials.

In the past, various patents have issued relating to the devices for installing underpinning piles retroactively for the support of a structure. For example, U.S. Pat. No. 5,288,175, issued on Feb. 22, 1994 to D. W. Knight, describes a continuously reinforced segmental precast concrete underpinning pile. A method of installing the underpinning pile is used where a high-strength strand aligns the precast segments during installation. The strand provides a means for measurement of the pile penetration depth. The strand continuously reinforces the pile when bonded or anchored upon completion. This patent describes a further process whereby a strand is affixed to a first pile segment prior to being driven into the earth. The first pile segment, along with the attached strand, is driven a desired distance into the earth from the supporting structure. The strand will extend upwardly and outwardly from an end of the first pile segment. The second pile segment then slides along the strand until the second pile segment contacts an end of the first pile segment. The second pile segment is then driven into the earth for a desired distance. Ultimately, after each of the pile segments is driven a desired distance into the earth, a cap member is affixed to the top of the array of pile segments so as to be placed under the foundation of the structure.

U.S. Pat. No. 5,399,055, issued on Mar. 25, 1995 to E. T. Dutton, Jr., teaches a device and method to level and repair a failed concrete foundation. A series of cylindrical pile segments are jacked into the soil to a pre-determined depth so as to attain sufficient skin friction. Water jetting is utilized during the jacking process to loosen and remove soil. Reinforcing steel is inserted into the stacked column of cylindrical pile segments and grout is further pumped into the cylindrical pile segments to suitably fix the reinforcing steel to the inside of the cylindrical piles. This forms a single shaft pile so as to eliminate or reduce pile deflection and shear.

U.S. Pat. No. 5,713,701, issued on Feb. 3, 1998 to F. S. Marshall, describes a foundation piling which has a metallic piling sleeve member filled with solidified or cured cementitious material and a hollow, cylindrical outer sleeve member having a diameter larger than that of the metallic sleeve member. The outer sleeve member is placed generally concentrically around the piling sleeve member. The piling and the outer sleeve member are vertically driven into the soil. Further metallic piling sleeves and outer sleeve members are successively vertically driven into the soil until the piling is complete and the metallic piling sleeve and outer sleeve members abut one another in vertical relation.

U.S. Pat. No. 6,179,526, issued on Jan. 30, 2001 to Knight et al., shows a method of forming a pile isolation void. This method includes the steps of forming a foundation pile having an enlarged cross-section within a specific localized section, and driving the foundation pile a desired distance into the earth so as to form a pile isolation void directly above the enlarged cross-section. The enlarged cross-section can be located at the bottom of the foundation pile or along the length of the foundation pile. The pile isolation void is an annular void extending around the foundation pile above the enlarged cross-section. This pile isolation void can be filled with a material, such as liquid, gel or a solid material different than the material of the pile or of the earth.

U.S. Pat. No. 6,193,442, issued on Feb. 27, 2001 to D. R. May, provides a method and device for raising and supporting a building foundation. The lifting assembly for raising and supporting the foundation of a structure is made of a bracket that secures to the base of the building foundation, a pier driven into the ground to a layer of bedrock, a pier support secured to the bracket through which the pier extends, a pair of shafts which secure a pier plate and a hydraulic plate to the pier support. The pier plate rests on a top end of the pier. A hydraulic jack is placed on top of the pier plate. The hydraulic plate is rigidly secured to the shafts when the hydraulic jack is activated. The hydraulic jack is held in a fixed position by the hydraulic plate and forces the pier plate down so as to drive the pier into the ground.

U.S. Pat. No. 6,200,070, issued on Mar. 13, 2001 to D. W. Knight, shows process of installing piles for supporting a structure upon the earth. This process includes the steps of forming a receptacle in a first pile segment, affixing an end of a strand into the receptacle such that the strand extends outwardly from the first pile segment, sliding a second pile segment onto the strand until the second pile segment contacts a surface of the first pile segment, and driving the second pile segment a desired distance into the earth. The receptacle is formed in the first pile segment while the first pile segment is in the earth.

U.S. Pat. No. 6,543,967, issued on Apr. 8, 2003 to F. S. Marshall, shows a staggered rebar design for concrete pilings. A first pile segment is driven into the earth. Two support rods of varying length are positioned and grouted into a passage running through the segment. The first support rod is one-half of the height of the pile segment, while the second is one and one-half times the height of the pile segment. An additional pile segment is driven on top of the first segment. Support rods, which are twice the height of a single segment, are positioned and grouted into the passage.

U.S. Pat. No. 6,634,830, issued on Oct. 21, 2003 to F. S. Marshall, describes a method and apparatus for post-tensioning segmented concrete pilings. A cable anchor serves as a base segment for multiple concrete piling segments. After installing all the concrete segments on top of the base segment, a cable is inserted into passages in the segments. The cable is threaded through the completely installed piling segments and into the cable anchor. After the cable bottoms out in the cable anchor, upward tension is applied to the cable. As the cable is pulled, cable lock members in the cable anchor increase gripping pressure as the cable tension increases so as to solidly anchor the end of the cable in the cable anchor.

U.S. Pat. No. 6,609,856, issued on Aug. 26, 2003 to D. W. Knight, describes a process of installing a precast concrete pile below a structure. This process includes the steps of driving a first pile segment into the earth a desired distance from the structure, aligning a second pile segment upon the first pile segments such that a conduit in the second pile segment is axially aligned with the conduit of the first pile segment, driving the first and second pile segments into the earth a desired distance from the structure, affixing a strand in the conduits of the first and second pile segments so as to form a starter section, and sliding another pile segment along the strand so as to reside upon the starter section. A plurality of pile segments are positioned along the strand so as to reside in stacked relationship upon the starter section. A cap member is positioned between the portion of the structure at an uppermost pile segment of the plurality of pile segments. An end of the strand is anchored in the cap member.

U.S. Pat. No. 6,659,692, issued on Dec. 9, 2003 to D. May, shows an apparatus and method for supporting a structure with a pier and helix. This helical pier assembly has the helix mounted on the end of the pier shaft. A pier-cap stabilizer is driven and forced down over the pier shaft until the top of the pier meets a stop pin secured in the pier cap. A platform screw jack is placed on top of the pier cap under the footing or foundation. The jack screws are extended down onto the pier cap until the platform jack comes into contact with the bottom of the footing or foundation. The jack screws are turned until the required support contact is achieved between the pier cap stabilizer and the footing or foundation.

U.S. Pat. No. 6,718,648, issued on Apr. 13, 2004 to T. S. Knight, shows a method of measuring a length of a pile which supports a structure upon the earth. This method includes the steps of affixing a flexible strand to a first pile segment, driving the first pile segment a desired distance into the earth such that the flexible strand extends along the length of the first pile segment along an exterior surface thereof, and driving a plurality of additional pile segments into the earth such that the pile segments reside upon an end of the first pile segment. The flexible strand extends along a length of the plurality of additional pile segments on the exterior surface thereof.

U.S. Pat. No. 6,722,820, issued on Apr. 20, 2004 to F. S. Marshall, provides a method of installing grout within a piling. Pile segments are driven into the ground on top of each other so as to form a piling. A single piling passageway is formed when the pile segments are in alignment. An alignment securing assembly is placed in the passageway. Vibrations are sent through the piling so that grout will not gather in the upper portions of the passageway before the lower portions of the passageway are filled with grout. The alignment securing assembly uses an anchoring device that is lowered and set in the passageway so that tension can be applied by a cable.

U.S. Pat. No. 6,763,636, issued on Jul. 20, 2004 to M. Dimitrijevic, provides a method and apparatus for lifting and leveling an existing building. At least a first non-cylindrical support section and a second support section are coupled together by a fastening device. A jack is used to raise the foundation of the existing building to a desired height. The apparatus is attached to the foundation of the building from underneath the building or from a location adjacent a side of the building.

U.S. Pat. No. 6,799,924, issued on Oct. 5, 2004 to Knight et al., describes a segmented concrete piling assembly with steel connecting rods. A first starter pile segment is driven into the soil adjacent the structure. A connecting rod is inserted into the upper end of the starter pile segment. A second or follower pile segment is placed on the upper end of the starter pile segment, over the connecting rod, and driven into the soil. This further drives the starter pile segment into the soil.

U.S. Pat. No. 6,881,012, issued on Apr. 19, 2005 to G. R. Covington, teaches a foundation repair system and method of installation. This system has continuously interlocked segmental precast concrete underpinning piles. A cooperating extension on one segment engages a cooperating depression on an adjacent segment. This aligns the precast segments during installation so as to provide a laterally stable pile.

U.S. Pat. No. 6,848,864, issued on Feb. 1, 2005 to Davie et al., discloses an interlocking slab leveling system for repairing building foundations by segmented underpinning. This method and apparatus repairs building foundations using interlocking segmented underpinning piles which are reinforced in the longitudinal direction.

U.S. Pat. No. 6,872,031, issued on Mar. 29, 2005 to D. May, describes an apparatus and method for supporting a structure with a pier. The pier assembly utilizes a rotatable shelf structure to place a screw jack assembly under a footing of a foundation. In particular, a pier is driven into the earth in proximity with a footer supporting the structure. A pier cast cap stabilizer shaft is mounted to a top end of the pier. A top portion of the pier cap stabilizer shaft extends above a bottom surface of the footer. The top portion of the pier cap stabilizer shaft is mounted to the footer. A shelf is mounted to the pier cap stabilizer shaft. A screw jack is positioned on a top surface of the shelf that adjustably extends between the shelf and the bottom surface of the footer.

U.S. Pat. No. 6,951,437, issued on Oct. 4, 2005 to D. B. Hall, provides a building foundation support and repair system. The system has a column of generally cylindrical pile sections driven into the earth below the edge of the foundation and an earth-penetrating bit attached to the lowermost pile section. The earth-penetrating bit includes a center post member extending within a bore in the lowermost pile section and/or a sidewall journaling the lower end of the lowermost pile section. The bit is connected to an elongated rod extending through the series of connected pile segments and is used to drive the bit rotatably during installation of the pile sections. This minimizes lateral excursion of the support system during and after installation of the column of pile sections.

U.S. Pat. No. 7,108,458, issued on Sep. 19, 2006 to Davie, Jr. et al., discloses a method and apparatus for repairing building foundations by segmented underpinning. In particular, there are a plurality of pile segments that are reinforced in a longitudinal direction. A precast starter segment has a coil embedded in one end of the segment and a coil rod protruding from the other end. The starter segment is driven into the earth with its protruding rod end facing downwardly. A second segment is interlocked with the first by threading the second segment's rod end into the coil of the starter segment. The second segment is screwed into the first segment until the two segments lock together.

U.S. Pat. No. 7,195,426, issued on Mar. 27, 2007 to D. May, provides a structural pier and method for installing the pier. The pier includes a pier shaft, a bracket mounted to a top end of the pier shaft that supports the weight of the foundation, and a pair of braces that extend laterally from the pier shaft and mount to the foundation.

U.S. Pat. No. 7,267,510, issued on Sep. 11, 2007 to M. Dimitrijevic, discloses a foundation pile or pile segment that provides support for a structure, such as a building foundation. The pile includes a generally solid body having a top end wall, a bottom end wall adapted for providing end load bearing capacity, and side walls. The side walls extend between the top end wall and the bottom end wall and each has at least a pair of oppositely disposed spiral ridges that extend generally about the surface of the side walls. Each spiral ridge extends in a generally spiral direction from the top end wall to the bottom end wall. The spiral ridges provide an offset surface that extends generally outward from the surface of the side walls.

U.S. Pat. No. 7,429,149, issued on Sep. 30, 2008 to Price et al., provides a sleeved, segmented support for supporting a foundation. This support comprises support segments that can be assembled together into a variable-length pile. The segments assemble together telescopically so that adjacent segments are held in coaxial relation and resist radial misalignment that can reduce the load-bearing capacity of the support product.

U.S. Pat. No. 7,857,549, issued on Dec. 28, 2010 to the present Applicant, describes an underpinning pile assembly for supporting a structure upon the earth. This underpinning pile assembly has at least one steel pipe, at least one concrete pile segment positioned above the steel pipe, and a transition member interposed between the steel pipe and the concrete pile such that the load of the concrete pile is supported by the steel pipe. The steel pipe includes a plurality of steel pipe segments extending in end-to-end relationship in generally vertical alignment. A key member is received in slots formed in the respective ends of the first and second segments. The plurality of concrete pile segments includes a strand affixed in holes formed through the plurality of concrete pile segments.

U.S. Pat. No. 8,500,368, issued on Aug. 6, 2013 to the present Applicant, describes an underpinning pile assembly and process for installing such underpinning pile assembly. The underpinning pile assembly supports a structure upon the earth and has at least one steel pipe with an interior passageway, a concrete pile segment positioned above the steel pipe, and a cable extending through an interior passageway of the steel pipe and through the interior passageway of the concrete pile segment. A locking assembly is connected to the cable and is affixed within the steel pipe. This locking assembly includes a collar having an outer surface affixed to an interior wall of the lowermost pipe. The cable is affixed within an interior of the collar. A pair of wedges secure the cable within the interior of the collar.

United States Patent Application Publication No. 2005/0025576, published on Feb. 3, 2005 to M. Dimitrijevic, provides a foundation pile that provides support for a structure, such as a building foundation. The pile includes a generally solid body having a top end wall, a bottom end wall adapted for providing end loading bearing capacity, and all-around side walls. The side walls extend between the top end wall and the bottom end wall and has at least a pair of oppositely disposed spiral ridges that extend generally around the surface of the side walls. Each spiral ridge extends in a generally spiral direction from the top end wall to the bottom end wall. The spiral ridges provide an offset surface that extends generally outward from the surface of the side walls. The offset surfaces provide additional load-bearing capacity to the foundation pile.

U.S. Patent Application Publication No. 2006/0269364, published on Nov. 30, 2006 to D. May, shows a pier that supports a foundation. The pier includes a pier shaft, a bracket mounted to the top end of the pier shaft, and a pair of braces that extend laterally from the pier shaft. The bracket supports the weight of the foundation. The pair of braces mount to the foundation.

U.S. Patent Application Publication No. 2006/0275086, published on Dec. 7, 2006 to Dimitrijevic et al., teaches a foundation piling base and a method of underpinning therefor. The piling base apparatus has a generally solid body, a top end surface, a bottom end surface, and a side surface extending between the top end surface and the bottom end surface. The surface area of the bottom end surface is less than the surface area of the top end surface. At least one ridge extends generally about the side surface in a generally downward direction from the top end surface to the bottom end surface. Each ridge has an offset surface extending generally outward from the surface of the side surface. An end of the strand is fixed to the piling base apparatus and extends outwardly from the top end surface.

U.S. Patent Publication No. 2008/0317556, published on Dec. 25, 2008 to M. Price, describes a pier system for supporting a building. The pier system includes a plurality of swaged pier segments in which each swaged pier segment is operable to be connected to another of the swaged pier segments. A hinged lifting platform is secured to an uppermost one of the swaged pier segments. At least one intermediate swaged pier segment is connected to the uppermost swaged pier segment. An encasement is provided for partial receipt of the intermediate swaged pier segment.

U.S. Patent Application Publication No. 2010/0021244, published on Jan. 28, 2010 to Dimitrijevic, describes the pile segment for foundation underpinning. The pile segment includes a head, a trunk extending from the head, and a throughbore passing axially through the head and the trunk. The throughbore has a longitudinal centerline. The area of a cross-section through the head and normal to the centerline is greater than the area of a cross-section through the trunk and normal to the centerline.

U.S. Patent Application Publication No. 2010/0021243, published on Jan. 20, 2010 to M. A. Dimitrijevic, shows a foundation underpinning that includes a pile having one or more pile segments and an elongated reinforcing tubular member. Each of the one or more pile segments includes a throughbore passing axially through the head and the trunk. The throughbores of the pile segments are vertically aligned forming a passage through the pile. The elongated reinforcing tubular member is disposed within the passage.

One of the problems associated with these prior art underpinning pile assemblies is the use of concrete pile segments. In certain earth formations, it becomes very difficult to drive these pile segments the proper and desired distance into the earth. In particular, when the earth is particularly hard and dense, great forces would be required so as to cause the pile segments to reach their intended depth. As such, it would be desirable to provide an underpinning pile assembly which allows the underpinning piles to reach the proper and desired depth in a simple, convenient and efficient manner.

Additionally, these prior art underpinning pile assemblies require the use of cylinders and/or shims in order to fix a distance between the top of the underpinning pile assembly and the bottom of the footing or foundation. Often, the configuration of the cylinders and/or shims is ineffective in establishing a secure support between the foundation and the top or cap of the underpinning pile assembly. In other circumstances, an inadequate amount or configuration of shims and/or cylinders is available on-site, as such, a great deal of adaptation would be required in order to effectively fill the void between the top of the underpinning pile assembly and the bottom of the foundation. As such, a need has developed so as to form an underpinning pile assembly which avoids for such cylinders and/or shims.

One of the problems associated with the use of steel pile systems is that they can become offset from one another. In certain circumstances, such as that described in U.S. Pat. No. 8,500,368, there is a strand that extends through the interior of the steel pipe segments. However, with sufficient force created by the earth, these pile segments can become dislodged from one another and/or extend at an arcuate angle. As such, a need has developed so as to provide additional assurance that the steel pile segments will be secured in longitudinal alignment and will resist deformation forces caused by the earth.

It is an object of the present invention to provide an underpinning pile assembly that is easy to install.

It is another object of the present invention to provide an underpinning pile assembly which provides a rigid support.

It is another object of the present invention to provide an underpinning pile assembly that is adjustable.

It is another object of the present invention to provide an underpinning pile assembly that avoids the use of cylinders and shims for fixing the distance between the top or cap of the underpinning pile assembly and the bottom of the foundation of the structure supported on the earth.

It is a further object of the present invention to provide an underpinning pile assembly that is infinitely adjustable to the distances between the pier and the structure.

It is another object of the present invention is to provide an underpinning pile assembly that avoids deflecting or deforming resulting from the shifting of the earth.

It is another object of the present invention to provide an underpinning pile assembly that allows a cable to extend continuously throughout the interior of the underpinning pile assembly.

These and other objects and advantages of the present invention will become apparent from a reading of the attached specification and appended claims.

BRIEF SUMMARY OF THE INVENTION

The present invention is an underpinning pile assembly for supporting a structure upon the earth. The underpinning pile assembly comprises a plurality of pile segments, a cable extending through a continuous passageway of the plurality of pile segments, and an anchor assembly positioned at the top of the plurality of pile segments. Each of the plurality of pile segments has an interior passageway. The plurality of pile segments are stacked one upon another such that the interior passageways form the continuous passageway through the plurality of pile segments. The cable has a lower end affixed to or adjacent to one of the plurality of pile segments. The anchor assembly has an opening receiving a portion of the cable therein. The anchor assembly fixes a position of an upper end of the cable.

The anchor assembly has at least one column extending upwardly from the upper surface thereof. An adjustable support is affixed to the column. This adjustable support has a surface opposite the column which is adapted to support the structure thereon. The adjustable support specifically includes a shaft extending to the column and adjustably received within the column, and a panel affixed to the shaft at an end opposite the column. The panel is the surface that supports the structure. The column has a threaded hole formed therein. The shaft is threadedly received in the threaded hole of the column. The panel is positioned in parallel planar relationship to the upper surface of the anchor assembly. The column includes a pair of columns each having the adjustable support extending therefrom.

The opening of the anchor assembly is adjacent to the upper surface thereof. A wedge is position in the opening of the anchor assembly. This wedge is interposed between the wall of the opening and the outer surface of the cable. The wedge comprises a pair of wedges positioned in the opening of the anchor assembly. The pair of wedges bear against the cable at the upper surface of the anchor assembly.

The pile segments are arranged in end-to-end relationship. The cable is affixed at a lowermost pile of the plurality of pile segments. The lowermost pile has a wedge assembly therein. The cable is secured in this wedge assembly. The plurality of pile segments are interlocked in end-to-end relationship. Each and all of the plurality of pile segments is formed of a steel material.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
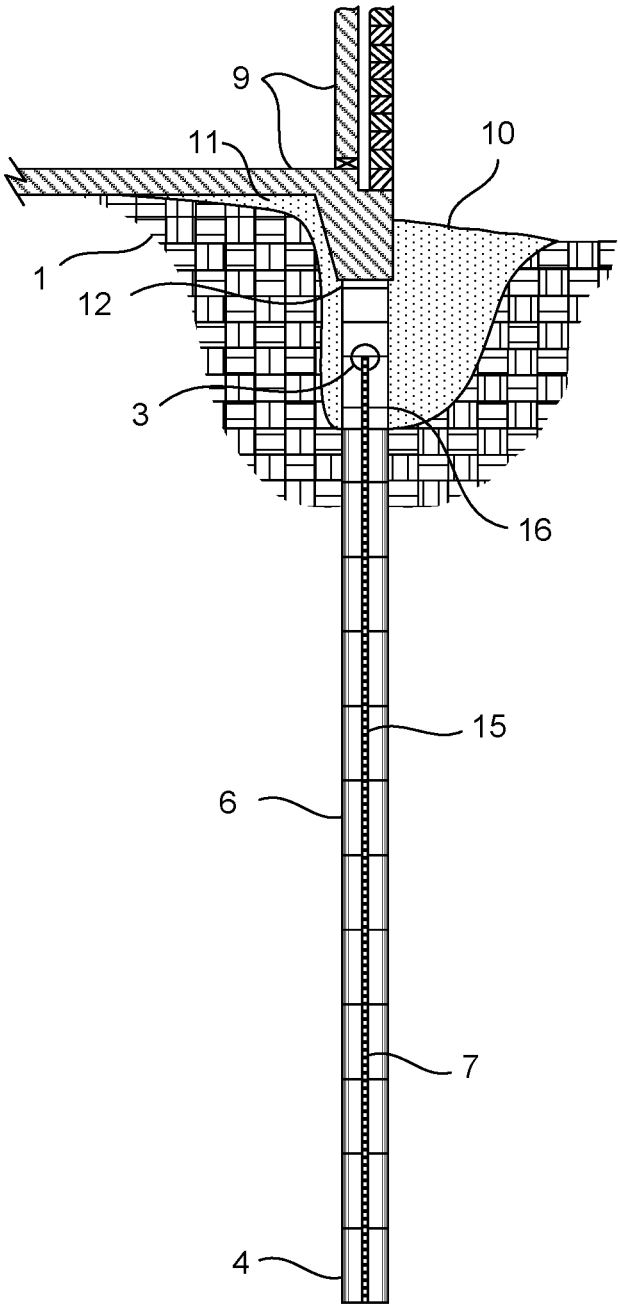
FIG. 1 PRIOR ART
FIG. 1 is a side cross-sectional view of an underpinning pile assembly of a prior art.
Figure 2:
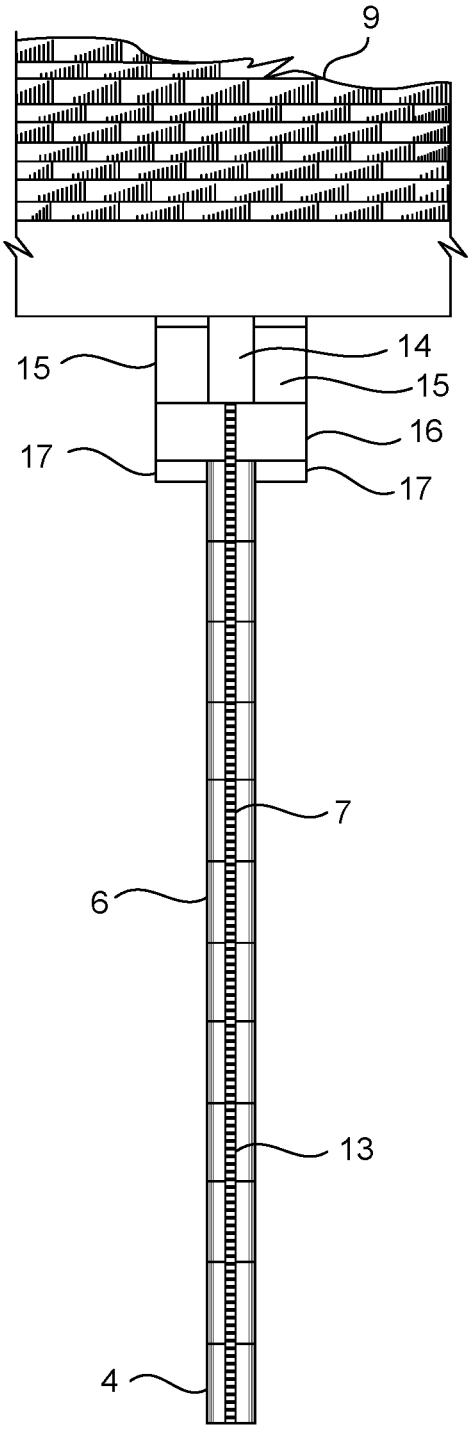
FIG. 2 PRIOR ART
FIG. 2 is a frontal view of the underpinning pile assembly of the prior art of FIG. 1.

FIGS. 1 and 2 show a prior art underpinning pile assembly in accordance with the teachings of U.S. Pat. No. 5,288,175. These show a side view and a front view, respectively, showing the completed installation beneath the perimeter of an existing structure 9. A graduated strand has been trimmed flush at the point of installation 3. The annular space between the strand and the concrete 13 has been injected with a structural adhesive. This completed installation incorporates void spaces 17 beneath the pile 16 to reduce the possibility of damage due to swelling or heaving of clay soils.

The underpinning operation is completed upon lifting foundation 11 and shimming 12 between the support blocks 15 and the existing structure 9. Lifting is carried out with jacks placed in the space 14 between the support blocks 15. The underpinning installation is then backfilled with soil fill.

The underpinning assembly includes a starter segment with a graduated high-strength steel strand 7 anchored and extending from the center of one end. Pile 6 and a pile cap 16 are each manufactured having strandways. The segments 4 and 6 are typically precast concrete, either circular or square in cross-section. There usually one foot in height. The strand 7 is typically high-strength steel. The strand can be anchored or bonded within the starter segment in several ways. The strand can be embedded and bonded to fresh concrete during the manufacture of the starter segment by using a two-component epoxy bonding agent. The pile cap 16 is typically precast of steel fiber reinforced concrete and can be of various configurations. It can be a rectangular prism with the strand-way formed through the short dimension at the midpoint of the long dimension. A structural adhesive 13, typically a two-component epoxy, is used to bond the steel strand to the concrete components along the pile length.

In this configuration, it can be seen that there will remain a distance between the top of the pile segments and the bottom of the foundation. As such, cylinders and/or shims are required so as to fill this distance. In certain circumstances, the exact dimensions required to fill this distance are not available on-site. In other circumstances, shims and cylinders will be inaccurately chosen such that the void is not completely filled. The use of such concrete pile segments have the same disadvantages is described herein previously.

Figure 3:
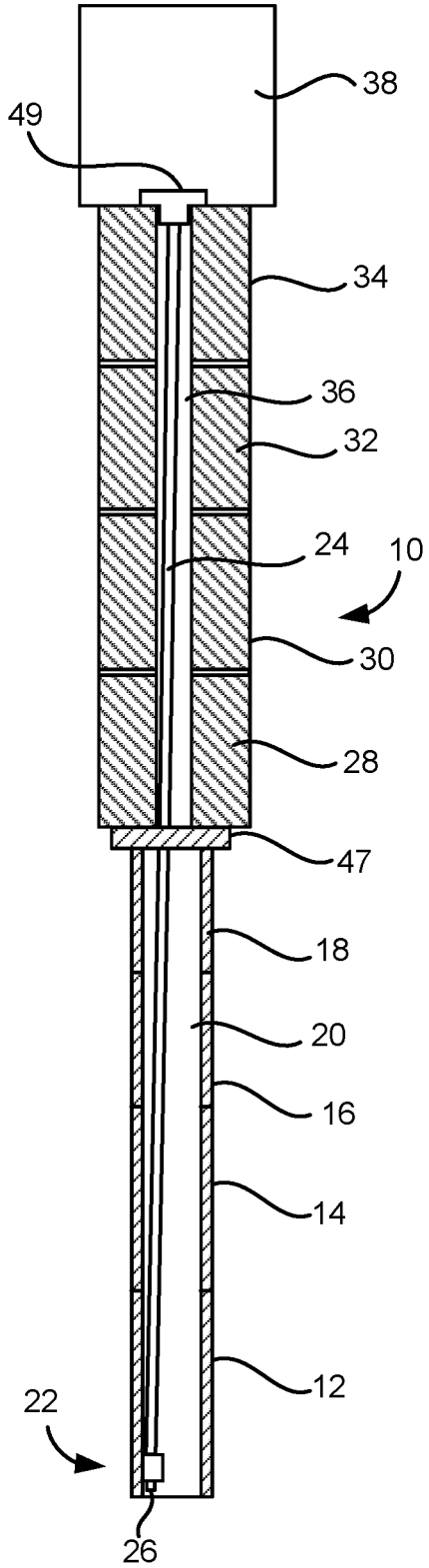
FIG.3 PRIOR ART
FIG. 3 is a cross-sectional view of another underpinning pile assembly of the prior art.

FIG. 3 shows an underpinning pile assembly of the prior art in accordance with the teachings of U.S. Pat. No. 8,500,368 of the present Applicant. The underpinning pile assembly 10 has a plurality of steel pipes 12, 14, 16 and 18 arranged in end-to-end stacked relationship to each other. Each of the steel pipes 12, 14, 16 and 18 has an interior passageway 20 extending therethrough. The lowermost pipe segment 12 has a collar 22 affixed to a wall of the interior passageway 20. The collar 22 is provided so that a cable 24 can have its end 26 affixed within the interior passageway of the lowermost pipe 12.

In FIG. 3, there is a plurality of concrete pile segments 28, 30, 32 and 34 arranged in an end-to-end stacked relationship. The plurality of concrete pile segments 28, 30, 32 and 34 has an interior passageway 36 extending therethrough. Generally, the interior passageway of the plurality of concrete pile segments 28, 30, 32 and 34 is axially aligned with the interior passageway 20 of the steel pipes 12, 14, 16 and 18. A pile cap 38 is positioned on the uppermost pile segment 34.

The cable 24 extends through the interior passageway 36 of the plurality of concrete pile segments 28, 30, 32 and 34 and also through the interior passageway 20 of the steel pipes 12, 14, 16 and 18. The cable 24 will have an end 26 residing within the interior passageway 20 of the lowermost steel pipe 12. The collar 22 is secured to the end 26 of the cable 24 and generally abuts the interior wall of the lowermost steel pipe 12. As such, the cable 24 will be fixed within the interior passageways 12 and 36.

The collar 22 is affixed against the inner wall of the lowermost steel pipe 12. The collar can be affixed by welding to this inner wall. The end 26 of the cable 24 can then be secured within the interior of the collar 22 so that the end 26 of the cable 24 is in a fixed position within the interior of the lowermost steel pipe 12. The steel pipe 12 can then be driven into the earth a desired distance from a structure that is supported by the pile cap 38.

The steel pipes 12, 14, 16 and 18 can be locked one upon each other through the use of engaging upsets (as shown hereinafter). In other words, an end of one pipe is received within an interior of another pipe so as to have a shoulder abutting the end of the pipe. As such, a proper driving of consecutive steel pipes can be achieved.

In the process shown in FIG. 3, the steel pipes 12, 14, 16 and 18 are consecutively driven into the earth for a desired distance from the structure supported by the pile cap 38. The cable 24 is affixed to the lowermost steel pipe 12 so it extends therefrom and through the interior passageway of the steel pipes 12, 14, 16 and 18. A transition member 47 is threaded along the cable 24 and positioned so as to reside against the top of the uppermost steel pipe 18. The concrete piles 28, 30, 32 and 34 are consecutively threaded along the cable 24 such that the lower most pile segment 28 will reside on a top of the transition member 47. The concrete pile segments 28, 30, 32 and 34 have a diameter that is approximately twice the diameter of the steel pipes 12, 14, 16 and 18. An anchor 49 is affixed to the cable 28 at the uppermost concrete pile segment 34. As such, the anchor 49 secures the cable 24 in a proper position through the interior passageways 20 and 36 in a generally vertical orientation. The pile 38 is suitably threaded along the cable so as to reside in a position above the uppermost concrete pile segment 34.

Figure 4:
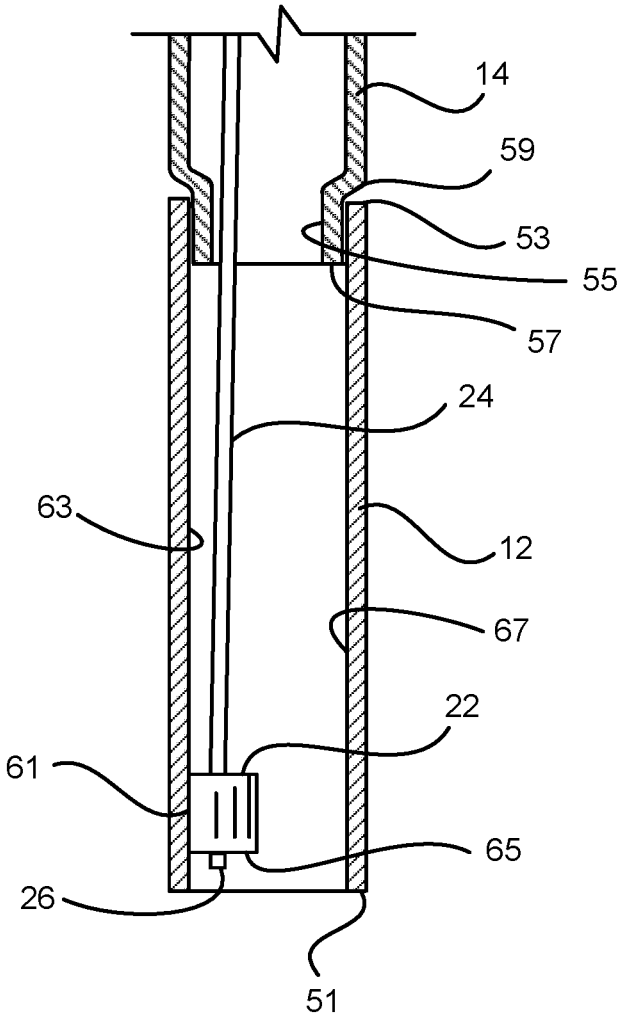
FIG.4 PRIOR ART
FIG. 4 is a cross-sectional view showing the technique for locking a cable to a pile of the underpinning pile assembly of the prior art of FIG. 3.

FIG. 4 illustrates the manner of locking an end of the cable 24 into a lowermost steel pipe and one technique of interlocking one steel pipe segment to another steel pipe segment. This is in accordance with the teachings of FIG. 3 and in accordance with the teachings of the present invention.

In particular, it can be seen that the lowermost steel pipe 12 is a generally constant diameter between the end 51 and the end 53. The steel pipe segment 14 is illustrated as having an upset 55 formed at an end 57 thereof. The upset 55 will define a segment that has an outer diameter that is less than the inner diameter of the lowermost steel pipe 12. A shoulder will be defined between the upset 55 and the remainder of the steel pipe segment 14. The shoulder 59 will reside against the end 53 of the lowermost steel pipe segment 12.

As a result of the configuration of the upset 55, the first steel pipe segment 12 can be driven a desired distance into the earth. The steel pipe segment 14 will have its end 57 inserted into the end 53 of the pipe segment 12. As such, a secure fit is achieved between the steel pipe segments 12 and 14. A driving force applied upon the steel pipe 14 will cause a corresponding movement of the pipe segment 12 by virtue of the forces applied from the shoulder 59 of the steel pipe 14 and the end 53 of the steel pipe 12. This arrangement also assures that the steel pipe 14 will be in a straight vertical alignment with the steel pipe 12. This is one technique for locking the pile segments in end-to-end relationship. Another technique for locking the steel pipes in end-to-end relationship will be shown hereinafter in connection with FIG. 9.

In FIG. 4, it can be seen that the collar 22 has a surface 61 that is affixed to the side 63 of the inner wall of the steel pipe 12. The collar 22 has a generally cylindrical configuration with an interior passageway. The cable 24 extends through the interior passageway of the collar 22 so as to have end 26 extending outwardly therefrom. The bottom 65 of the collar 22 is in spaced relationship inwardly from the end 51 of the steel pipe 12. The cable 24 will then extend upwardly, and generally vertically, through the interiors of the steel pipes 12 and 14. The opposite side 67 of the inner wall of the steel pipe is in spaced relationship from the outer diameter of the collar 12. As such, proper water injection can be applied to the interior of the steel pipes 12 and 14 and outwardly of the end 51 through the space defined between the collar 22 and the side 67. As such, the application of the collar 22 will not interfere with proper installation of the steel pipes 12 and 14 into the earth.

Figure 5:
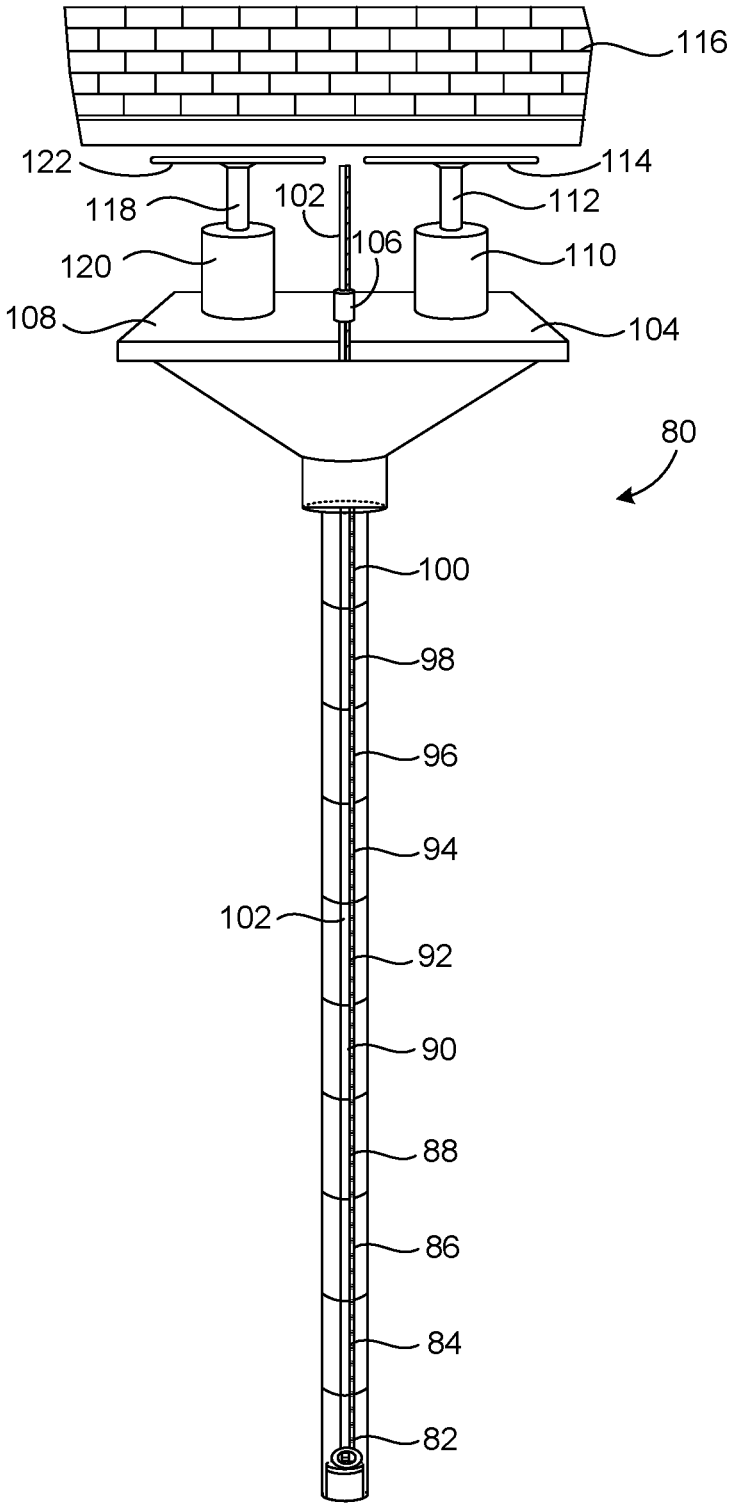
FIG. 5 is an upper perspective view showing the underpinning pile assembly in accordance with the present invention.

FIG. 5 shows the underpinning pile assembly 80 in accordance with teachings of the present invention. The underpinning pile assembly 80 includes a plurality of pile segments 82, 84, 86, 88, 90, 92, 94, 96, 98 and 100. More or fewer pipe segments can be used, as desired. Each of the plurality of pile segments 82, 84, 86, 88, 90, 92, 94, 96, 98 and 100 has an interior passageway. This plurality of pipe segments are stacked one upon another such that the interior passageways of each of the plurality of pile segments forms a continuous passageway through the plurality of pile segments. A cable 102 extends through this continuous passageway of the plurality of pile segments 82, 84, 86, 88, 90, 92, 94, 96, 98 and 100. The cable 102 has a lower end affixed to the lowermost pile segment 82. An anchor 104 is positioned at a top of the uppermost pile segment 100. The anchor 104 has an opening 106 receiving a portion of the cable 102 therein. The anchor assembly 104 affixes a position of the upper end of the cable 102 therein. This anchor assembly 104 has an upper surface 108. The anchor assembly 104 has at least one column 110 extending upwardly from the upper surface 108 thereof. An adjustable support 112 is affixed to the column 110. The adjustable support has a surface 114 opposite the upper surface 108 of the anchor assembly 104. Surface 104 is adapted to support the structure 116 thereon.

In particular, the adjustable support 112 includes a shaft 118 that extends to the column 120. The shaft 118 is adjustably received within the column 120. Column 120 corresponds to the column 110. A panel 122 is affixed to the shaft at an end opposite the column 120. This panel 122 is similar to the surface 114 that supports the structure 116.

As will be described hereinafter, each of the columns 110 and 120 has a threaded hole formed therein. The shaft associated with the adjustable support 112 and the shaft 118 are threadedly received within the threaded hole of the columns 110 and 120. The surface 114 and the panel 122 are positioned in parallel planar relationship to the upper surface of the anchor assembly.

In the arrangement shown in FIG. 5, it can be seen that the cable 102 extends entirely through the plurality of pile segments 82, 84, 86, 88, 90, 92, 94, 96, 98 and 100. As such, the present invention avoids the use of concrete pile segments of the prior art and the problems associated with such concrete pile segments. The driving of the plurality of pile segments into the earth is relatively easy. Ultimately, the anchor assembly 104 will be secured to the uppermost pile segment 100 in a fixed arrangement. Since the anchor assembly 104 will reside a small distance below the structure 116, the adjustable support 112 is provided so as to allow the surfaces thereon to move so as to be positioned at the bottom surface of the structure 116. As such, the present invention effectively avoids the use of columns, cylinders and shims associated with the prior art. These adjustable supports are infinitely adjustable so that they can be configured so as to directly match the space between the column 110 and the support structure 116. In the present invention, each of the plurality of pile segments 82, 84, 86, 88, 90, 92, 94, 96, 98 and 100 are interlocked together (such as in the manner of FIG. 4 or 9) and they are secured together by compression forces caused by the tensioned cable 102 extending therethrough. As such, this provides a double technique for avoiding any deflection forces to the underpinning pile assembly 80 caused by the shifting of the earth.

Figure 6:
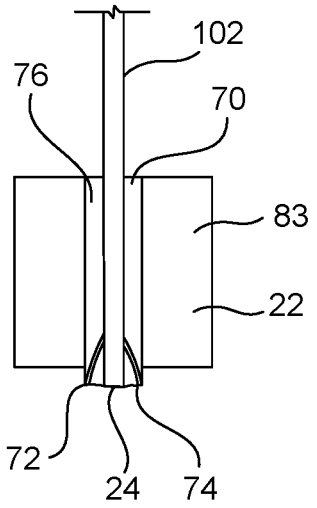
FIG. 6 is a cross-sectional view showing the locking of the lower end of the cable within the lowermost pile segment of the present invention.
Figure 7:
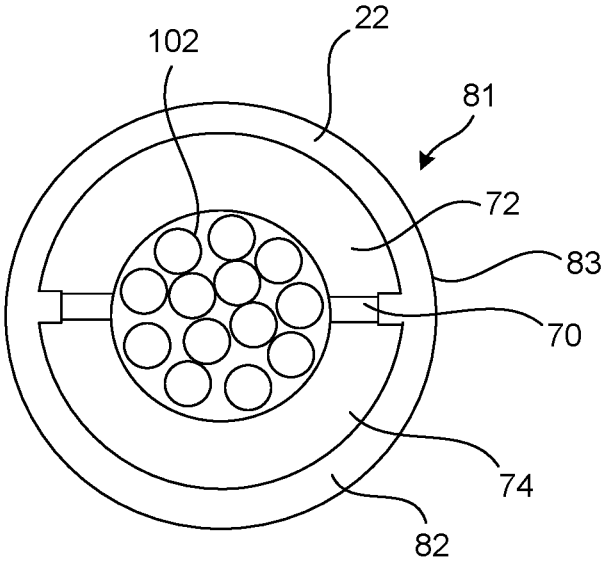
FIG. 7 is a plan view showing the locking of the lowermost end of the cable within the pile segment of the present invention.

FIGS. 6 and 7 show, in particular, how the lowermost end of the cable 102 is secured to the lowermost pile segment 82. In particular, the cable 102 is affixed within the interior passageway 70 of the collar 22. In particular, a pair of wedges 72 and 74 are affixed around the end 26 of the cable 102. The wedges 72 and 74 are inserted into the interior passageway 70 so as to wedge against the inner wall 76 of the interior passageway 70. As such, a strong interference-fit relationship is established between the wedges 72 and 74 and the outer surface of the cable 102 and the inner wall 76 of the interior passageway 70 of the collar 22 at the lowermost pile segment 82. As a result, the end 26 of the cable 102 is strongly fixed in position.

FIG. 7 illustrates an end view of the locking assembly 81 at the lowermost pile segment 82. In particular, the locking assembly 81 includes collar 22 having an outer surface 83. There is a first wedge 72 and a second wedge 74 that is received within the interior passageway 70 of the collar 22. The cable 102 is affixed against the inner wall of each of the wedges 72 and 74. As such, the wedges 72 and 74 generally surround the cable 24 so as to achieve a secure engagement therewith. The angled surfaces of the wedges 72 and 74 will be engaged within the wall 76 of the interior passageway 70 of the collar 22 so as to affix the cable 24 in its desired position.

Figure 8:
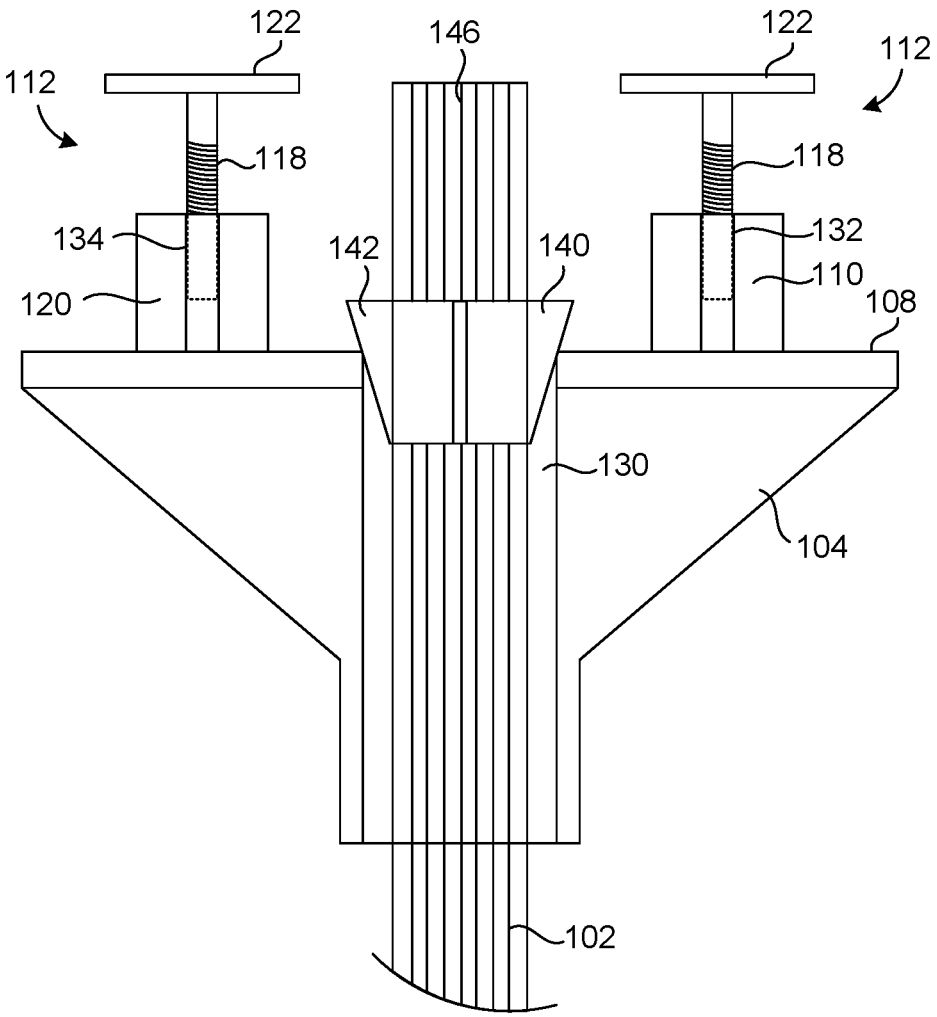
FIG. 8 is a cross-sectional view showing the anchor assembly of the present invention.

FIG. 8 shows the anchor assembly 104 as utilized in the underpinning pile assembly 80 of the present invention. In particular, the anchor assembly is positioned at the top of the plurality of pile segments (not shown in FIG. 8). The anchor assembly 104 has an opening 130 that receives a portion of the cable 102 therein. The anchor assembly 104 affixes a position of an upper end of the cable 102 therein. The anchor assembly 104 has columns 110 and 120 extending upwardly from the top surface 108 thereof. Column 110 has a threaded hole 132 formed therein. Similarly, column 120 has a threaded hole 134 formed therein. The adjustable supports 112 each include a shaft 118. The shaft 118 is suitably threaded so as to be threadedly received within the threaded holes 132 and 134 of columns 110 and 120. Panels 122 are located at the upper end of the shaft 118 so as to provide a building-supporting surface thereon. The surfaces 122 will be in parallel planar relationship to the upper surface 108 of anchor assembly 104.

The opening 130 of the anchor assembly 104 opens at the upper surface 108 of the anchor assembly 104. Wedges 140 and 142 are positioned in the opening 130 of anchor assembly 104. The wedges 140 and 142 are interposed between the wall of the opening 130 and an outer surface of the cable 102. The pair of wedges 140 and 142 bear against the cable at the upper surface of the anchor assembly 104. The end 146 of cable 102 can be suitably tensioned, if desired, so as to create a tension force that retains the anchor assembly 104 rigidly against the uppermost pile 110 and secures the alignment of the plurality of pile segments 82, 84, 86, 88, 90, 92, 94, 96, 98 and 100.

Figure 9:
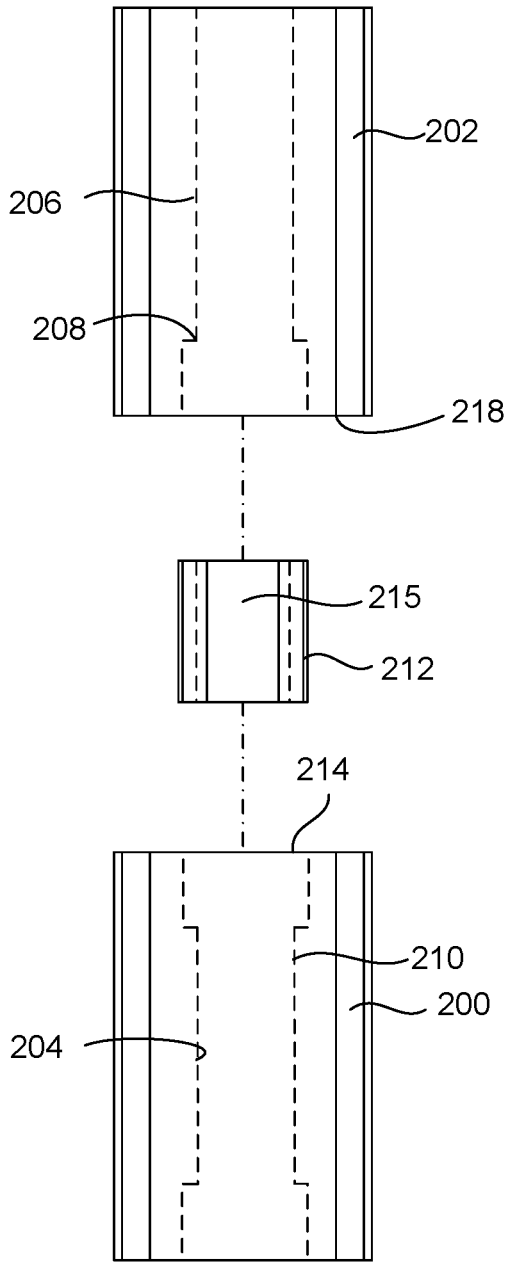
FIG. 9 is a side elevational view showing one manner of locking the pipe segments in end-to-end relationship in accordance with the teachings of the present invention.

FIG. 9 shows another technique for causing the pile segments to be interlocked in end-to-end relationship. In particular, in FIG. 9, it can be seen that pile segments 200 and 202 are arranged generally in end-to-end relationship. Pile segment 200 has an interior passageway 204 therein. Pile segment 202 has interior passageway 206 therein. Interior passageway 206 will have a shoulder 208 defined therein. Similarly, a shoulder 210 is defined in pile segment 200. Shoulders 208 and 210 are formed so as to extend into the respective interior passageways 206 and 204. A key member 212 is inserted into the ends 214 and 218 of the respective pile segments 200 and 202. As such, this key 212 will serve to properly align the pile segment 200 with the pile segment 202. Key 212 will have a interior passageway 215 therein which will align with the interior passageways 204 and 206 of the respective pile segments 200 and 202. The key 212 is inserted into the interior passageway 204 of pile segment 10 until it abuts the shoulder 210. The upper end of the key 212 is inserted into the interior passageway 206 of the pile segment 202 until it abuts the shoulder 208. As such, this provides a manner in which the pile segments 200 and 202 can be interlocked in end-to-end relationship while, at the same time, allowing the passage of the cable 102 therethrough.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An underpinning pile assembly for supporting a structure upon the earth, the underpinning pile assembly comprising:

a plurality of pile segments, each of said plurality of pile segments having an interior passageway, said plurality of pile segments being stacked one upon another such that the interior passageways form a continuous passageway through said plurality of pile segment;

a cable extending through the continuous passageway of said plurality of pile segments, said cable having a lower end affixed to or adjacent to one of said plurality of pile segments; and an anchor assembly positioned at a top of said plurality of pile segments, said anchor assembly having an opening receiving a portion of said cable therein, said anchor assembly fixing a position of an upper end of said cable therein, said anchor assembly having an upper surface, said anchor assembly having at least one column extending upwardly from the upper surface thereof, the underpinning pile assembly further comprising:

an adjustable support affixed to the at least one column, said adjustable support having a surface opposite the at least one column that is adapted to support the structure thereon.

2. The underpinning pile assembly of claim 1, said adjustable support comprising:

a shaft extending to the at least one column, said shaft being adjustably received in the at least one column; and a panel affixed to said shaft at an end opposite the at least one column, said panel being the surface of said adjustable support.

3. The underpinning pile assembly of claim 2, the at least one column having a threaded hole form therein, said shaft being threadedly received in the threaded hole of the at least one column.

4. The underpinning pile assembly of claim 2, said panel being positioned in parallel planar relationship to the upper surface of said anchor assembly.

5. The underpinning pile assembly of claim 1, the at least one column comprising a pair of columns each having the adjustable support extending therefrom.

6. The underpinning pile assembly of claim 1, said plurality of pile segments being arranged end-to-end relationship, said cable being affixed at a lowermost pile of said plurality of pile segments.

7. The underpinning pile assembly of claim 6, the lowermost pile having a wedge assembly therein, said cable being secured in said wedge assembly.

8. The underpinning pile assembly of claim 1, said plurality of pile segments being interlocked in end-to-end relationship.

9. The underpinning pile assembly of claim 8, each of said plurality of pile segments being formed of a steel material.

10. An underpinning pile assembly for supporting a structure upon the earth, the underpinning pile assembly comprising:

a plurality of pile segments, each of said plurality of pile segments having an interior passageway, said plurality of pile segments being stacked one upon another such that the interior passageways form a continuous passageway through said plurality of pile segment;

a cable extending through the continuous passageway of said plurality of pile segments, said cable having a lower end affixed to or adjacent to one of said plurality of pile segments; and an anchor assembly positioned at a top of said plurality of pile segments, said anchor assembly having an opening receiving a portion of said cable therein, said anchor assembly fixing a position of an upper end of said cable therein, said anchor assembly having an upper surface, the opening of said anchor assembly being adjacent the upper surface thereof, the underpinning pile assembly further comprising:

a wedge positioned in the opening of said anchor assembly, said wedge interposed between the wall of the opening at an outer surface of said cable, said wedge comprising a pair of wedges positioned in the opening of said anchor assembly, the pair of wedges bearing against said cable at the upper surface of said anchor assembly.

11. An underpinning pile assembly for supporting a structure upon the earth, the underpinning pile assembly comprising:

a plurality of pile segments, each of said plurality of pile segments having an interior passageway, said plurality of pile segments being stacked one upon another such that the interior passageways thereof form a continuous passageway through said plurality of pile segments;

a cable extending through the continuous passageway of said plurality of pile segments, said cable having a lower end affixed to or adjacent to one of said plurality of pile segment;

an anchor assembly positioned at a top of said plurality of pile segments, said anchor assembly having an opening receiving a portion of said cable therein, said anchor assembly fixing a position of an upper end of said cable therein, said anchor assembly having an upper surface, said anchor assembly having at least one column extending upwardly from the upper surface thereof; and a pair of adjustable supports affixed respectively to the pair of columns, said pair of adjustable supports having a surface opposite the pair of columns that is adapted to support the structure thereon, each of said pair of adjustable supports comprising:

a shaft extending to the at least one column, said shaft being adjustably received in the column; and a panel affixed to said shaft at an end opposite the column, said panel being the surface of said adjustable support.

12. The underpinning pile assembly of claim 11, each of the pair of columns having a threaded hole formed therein, said shaft being threadedly received in the threaded hole of the each of the pair of columns.

13. The underpinning pile assembly of claim 11, said plurality of pile segments being arranged in end-to-end relationship, said cable being affixed to a lowermost pile of said plurality of pile segments.

14. The underpinning pile assembly of claim 13, the lowermost pile having a wedge assembly therein, a lower end of said cable being secured in said wedge assembly.

15. The underpinning pile assembly of claim 11, said plurality of pile segments being interlocked in end-to-end relationship.

* * * * *